US006935207B2

(12) United States Patent
Mazza

(10) Patent No.: US 6,935,207 B2
(45) Date of Patent: Aug. 30, 2005

(54) JAR LID OPENER

(76) Inventor: Franco Mazza, Apt. 4, 4897 Barclay Avenue, Montreal, Quebec (CA), H3W 1E1

( * ) Notice: Subject to any disclaimer, the term of this patent is extended or adjusted under 35 U.S.C. 154(b) by 0 days.

(21) Appl. No.: 10/301,618

(22) Filed: Nov. 22, 2002

(65) Prior Publication Data

US 2004/0099097 A1 May 27, 2004

(51) Int. Cl.[7] ..... B67B 7/00

(52) U.S. Cl. ..... 81/3.2; 81/3.29; 81/464; 81/465

(58) Field of Search ..... 81/3.2, 3.33, 3.4, 81/463–466, 3.29, 3.43, 3.36; 173/93.5, 93, 176

(56) References Cited

U.S. PATENT DOCUMENTS

| | | | | | |
|---|---|---|---|---|---|
| 3,174,597 | A | * | 3/1965 | Schaedler et al. | 173/93.6 |
| 3,414,065 | A | * | 12/1968 | Falter | 173/93.5 |
| 4,262,560 | A | | 4/1981 | Hoffberger | |
| 4,306,470 | A | | 12/1981 | Woloszyn | |
| 4,313,505 | A | * | 2/1982 | Silvern | 173/93.5 |
| 4,585,078 | A | * | 4/1986 | Alexandrov et al. | 173/93.5 |
| 4,718,312 | A | * | 1/1988 | Jones | 81/3.2 |
| 4,751,861 | A | | 6/1988 | Workman | |
| 4,766,781 | A | | 8/1988 | Grisé et al. | |
| 4,949,576 | A | | 8/1990 | Floyd | |
| 4,995,295 | A | | 2/1991 | Floyd | |
| 5,003,844 | A | * | 4/1991 | Barrow | 81/3.2 |
| 5,035,161 | A | * | 7/1991 | Huang | 81/54 |
| 5,083,482 | A | | 1/1992 | Floyd | |
| 5,370,019 | A | | 12/1994 | Sartell et al. | |
| 5,546,831 | A | | 8/1996 | Grant et al. | |
| 5,617,765 | A | | 4/1997 | Bennett | |
| D429,980 | S | | 8/2000 | Warrick | |
| 6,125,718 | A | | 10/2000 | Hill | |
| 6,182,534 | B1 | | 2/2001 | Hardman | |
| 6,464,017 | B1 | * | 10/2002 | Chen | 173/93.5 |
| 6,648,080 | B1 | * | 11/2003 | Liao | 173/93.5 |

* cited by examiner

*Primary Examiner*—Hadi Shakeri
(74) *Attorney, Agent, or Firm*—Ogilvy Renault LLP; Wayne H. Yan

(57) ABSTRACT

An automatic jar lid opener comprises a cylindrical housing and a truncated conical lid retainer rotatably attached to the cylindrical housing. A rotary hammer assembly is installed in the housing to convert a torque output from a motor assembly in the housing, into a twisting impact force applied through the lid retainer to a threaded jar lid in order to break a seal or initial resistance securing the lid screwed on a jar.

15 Claims, 8 Drawing Sheets

JAR LID OPENER

FIELD OF THE INVENTION

The invention relates to jar lid openers and more particularly to automatic jar lid openers.

BACKGROUND OF THE INVENTION

Jars are commonly employed to contain household materials, particularly food stuffs, for convenient storage and retrieval. Jars are usually equipped with thin metallic or plastic lids which attach to the jars by means of cooperating threads. It has been recognized by those skilled in the art that there are many instances where manual removal of a jar lid is either very difficult or not feasible. For example, a lid may be too tightly installed during the manufacturing process, making it difficult to remove. Fluid trapped between the threads may also cause the lid to stick in a tightened position.

In order to assist persons who for what ever reasons need such assistance in opening a jar, numerous machines for unscrewing lids from jars have been proposed in the prior art. These prior art machines usually include a base having a vertical shaft on which is mounted a gripping device for holding a jar by its lid. The gripping device is disposed above a second gripping device located on the base. The second gripping device is used for holding the jar. One of the gripping devices is provided with powered rotation means and the other gripping device is immobile. In operation, a torque provided by the rotation means is imparted to the jar in order to break a seal or initial resistance securing the lid to the jar.

Examples of prior art jar lid opening machines are described in U.S. Pat. No. 5,370,019, issued to Sartell et al. on Dec. 6, 1994, U.S. Pat. No. 5,617,765, issued to Bennett on Apr. 8, 1997, U.S. Pat. No. 6,125,718, issued to Hill on Oct. 3, 2000 and U.S. Pat. No. 6,182,534, issued Hardman on Feb. 6, 2001.

The prior art jar lid opening machines usually do not have a compact configuration because they must include two gripping devices which are disposed spaced apart. However, this configuration is necessary in the prior art jar lid opening machines in order to provide a fully automatic operation, considering the powerful torque provided by the machines needed to break the seal or initial resistance securing the lid to the jar. Therefore, it is desirable to develop an improved powered jar lid opener which is compact and convenient to use.

SUMMARY OF THE INVENTION

One object of the present invention is to provide a powered jar lid opener which is compact in, configuration and convenient to use.

Another object of the present invention is to provide a powered jar lid opener which provides a twisting impact force to loosen a threaded lid on a jar.

In accordance with one aspect of the present invention, a jar lid opener for loosening a threaded jar lid on a jar comprises a housing, a jar lid retainer, a motor and a rotary hammer assembly. The jar lid retainer is rotatably attached to the housing for contacting the lid and for applying a twisting impact force to the lid to loosen the lid on the jar. The motor is installed in the housing for generating a torque. The rotary hammer assembly is installed in the housing and is coupled with the motor and the jar lid retainer for converting the torque output from the motor into the twisting impact force applied by the jar lid retainer to the lid.

The rotary hammer assembly preferably includes a first rotary element adapted to be driven by the motor to rotate, and a second rotary element adapted to rotate together with the jar lid retainer. The rotary hammer assembly further includes a hammer device driven by the first rotary element to strike the second rotary element in order to begin rotation.

In one embodiment of the present invention, the rotary hammer assembly includes an anvil shank engaging the jar lid retainer and rotatable together with the jar lid retainer. A hammer cage is provided which is rotatable about an axis of the anvil shank, and is coupled with the motor. At least one hammer pin is received in the hammer cage and is moveable axially between an upper position in which the hammer pin cannot be in contact with the anvil shank when the hammer cage rotates, and a lower position in which the hammer pin is in an active position to strike the anvil shank. A cam plate is attached to the anvil shank to force the hammer pin to move axially between the upper and lower positions as the hammer cage rotates.

In another embodiment of the present invention, the rotary assembly includes an anvil shank having a cam surface. The anvil shank engages the jar lid retainer and is rotatable together with the jar lid retainer. A hammer cage is provided which is rotatable about an axis of the anvil shank. A hammer dog is mounted on the hammer cage and is pivotable relative to the hammer cage, about an axis parallel with the axis of the anvil shank. The hammer dog is guided by the cam surface of the anvil shank to strike the anvil shank one time upon each revolution of the hammer cage. A driving plate is coupled with the motor and linked with the hammer cage for driving the hammer cage to rotate.

It has been recognized that in order to open a threaded lid on a jar it is not necessary to apply a constant torque because the torque is only needed instantly to break a seal or initial resistance securing the lid to the jar. Once the lid is loosened, it is easy to further rotate the lid manually and remove same from the jar. It is also recognized that impact forces are much more effective than constant forces in some actions, especially for instant actions and thereby relatively less energy is required. For example, it is much easier to use a hammer to strike a nail down into a hard solid object than applying a constant force to the nail. Therefore, the intention of the present invention is to convert a constant torque provided by an electrical motor into a twisting impact force to break a seal or initial resistance securing the lid to the jar. This will be more effective than applying a constant torque, as with conventional automatic jar lid opening machines, and will require relatively less energy. The sharp blows delivered by the rotating hammer requires very little effort to hold the jar. Thus, it is possible to apply the twisting impact forces to the lid while manually holding the jar, thereby resulting in a compact jar lid opener configuration and making the opener easy to use, in contrast to prior art in which there has been a preoccupation with ways for securing the jar.

Other advantages and features of the present invention will be better understood with reference to preferred embodiments described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENTS

Figure 1:
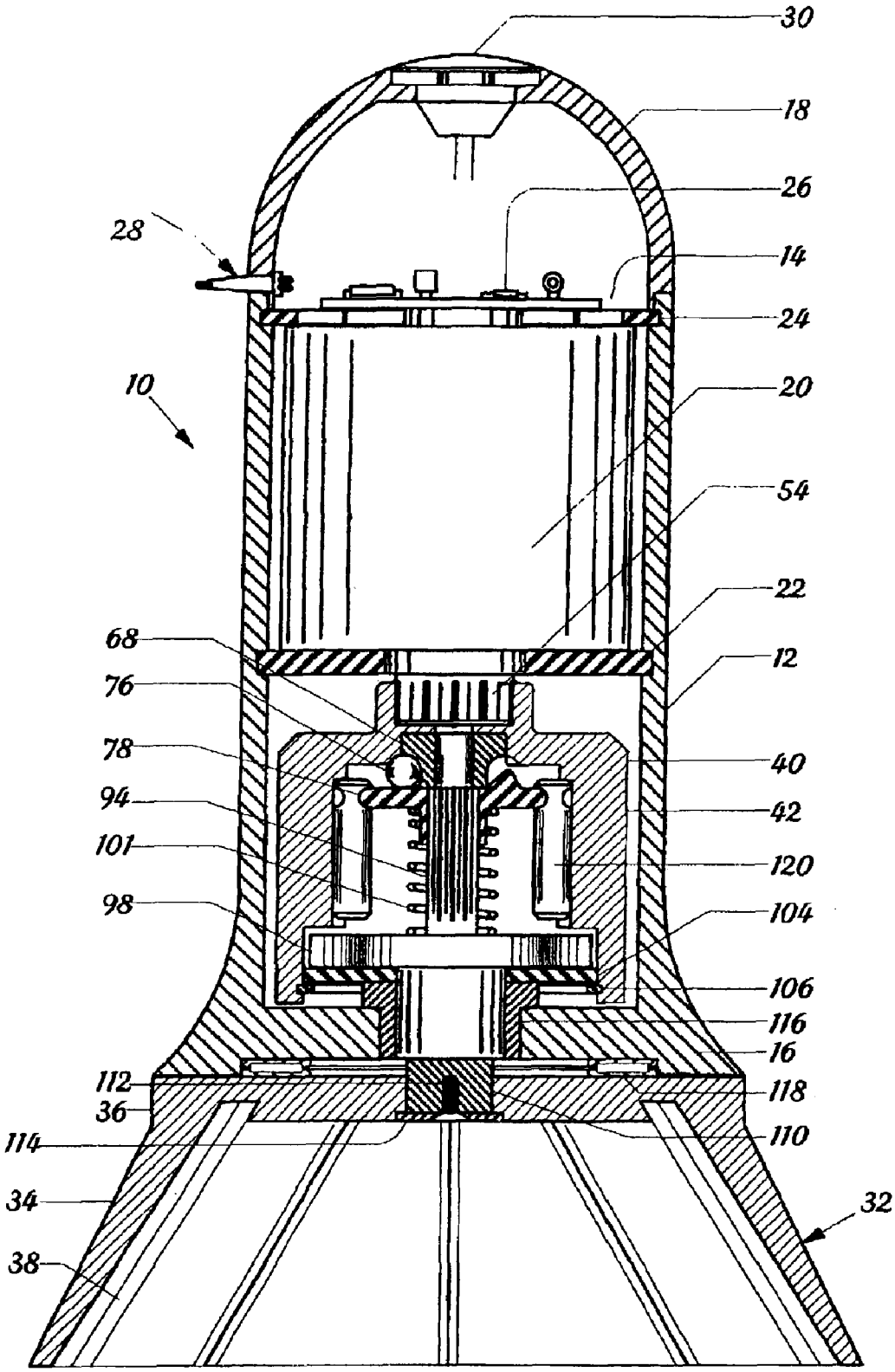
FIG. 1 is a cross-sectional view of a preferred embodiment of the present invention.

Referring to FIG. 1, a powered jar lid opener generally indicated by numeral 10 includes a housing which is preferably substantially cylindrical. The cylindrical housing 12 has an open top 14 and a closed bottom 16. A domed cover 18 is detachably secured to the open top 14 of the housing 12 by well known means to close same. A motor assembly 20 is installed in the housing 12 and is retained between a motor bracket 22 and a retainer ring 24 which are received in respective annular grooves (not indicated) in the inner wall of the cylindrical housing 12.

The motor assembly 20 is preferably a single electrical motor. An electric circuit plate 26 is attached to the motor assembly 20 and is in electrical connection with a power cord 28 and a activation switch 30, both of which are attached to the domed cover 18.

A jar lid retainer 32 is rotatably attached to the housing 12 at its bottom end 16 for contacting a threaded jar lid (not shown) and for applying a twisting impact force to the lid in order to loosen the lid on the jar. The jar lid retainer 32 is preferably a truncated conical grip head which includes a solid annular wall 34 extending radially outwardly from the outer periphery of a head plate 36. The head plate 36 is rotatably mounted to the bottom 16 of the cylindrical housing 12, which will be further described hereinafter. The cylindrical housing 12 preferably has an outer periphery and is gradually enlarged at the bottom 16 corresponding to the conical angle of the jar lid retainer 32, in order to present an aesthetically pleasing appearance. The truncated conical shape of the jar lid retainer 32 is adapted to accommodate jar lids of various sizes in order to securely hold the jar lid accommodated within the jar lid retainer 32, and thereby avoid slippage when applying the twisting impact force to the lid. Means for gripping the lid are provided on the inner surface of the radially and outwardly extending annular wall 34. In this embodiment grip blades 38, preferably made of hardened steel, such as carbide, are provided. A plurality of the grip blades 38 are affixed to the radially and outwardly extending annular wall 34. The carbide grip blades 38 extend radially and outwardly, corresponding to the conical angle of the jar lid retainer 32, and are circumferentially spaced apart.

A rotary hammer assembly 40 is installed in the cylindrical housing 12 and is coupled with the motor assembly 20 and the jar lid retainer 32, for converting the torque output from the motor assembly 20 into a twisting impact force applied by the jar lid retainer to the lid.

As more clearly illustrated in FIGS. 2–6, the rotary hammer assembly 40 includes a hammer cage 42 which includes a cylindrical wall 44, an open bottom 46 and a top wall 48. A cylindrical connector 50 coaxially extends from, and is preferably integrated with, the top wall 48. The cylindrical connector 50 includes a inner surface with splines 52 thereon for complimentary engagement with splines 54 on the output shaft (not indicated) of the motor assembly 20 (see FIG. 1). The cylindrical wall 44 includes an annular step 55 on its inner surface which divides the interior of the hammer cage 42 into a first chamber 56, and a second chamber 58 having a relatively smaller diameter. A circular recess 60 is formed on the inner side of the top wall 48 and is centered with cylindrical wall 44. The circular recess 60 is separated from the inside of the cylindrical connector 50 by an annular radial wall 62 which defines a central hole 64 therein. Two axial grooves 66 are disposed on diametrically opposed sides of the inner surface of the cylindrical wall 44 in the second chamber 58.

Figure 5:
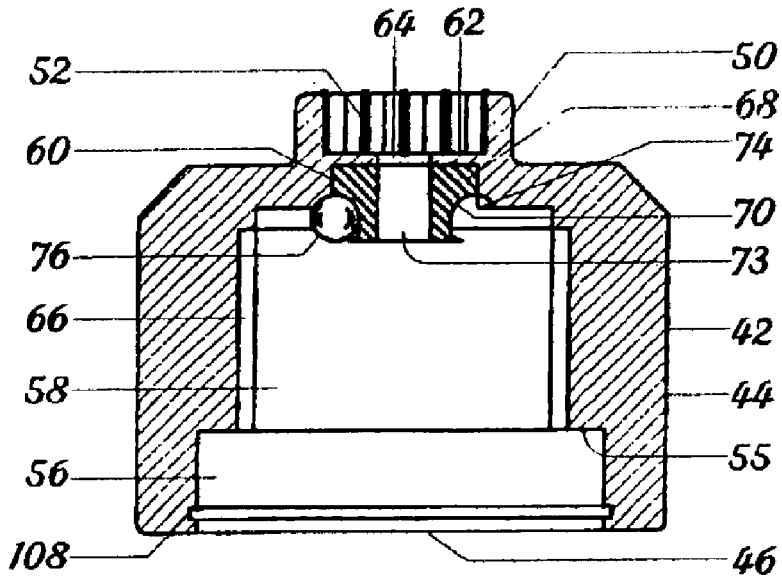
FIG. 5 is a cross-sectional view of a hammer cage with a cam ball pilot member as well as a cam ball installed in the rotary hammer assembly of FIG. 3.
Figure 6:
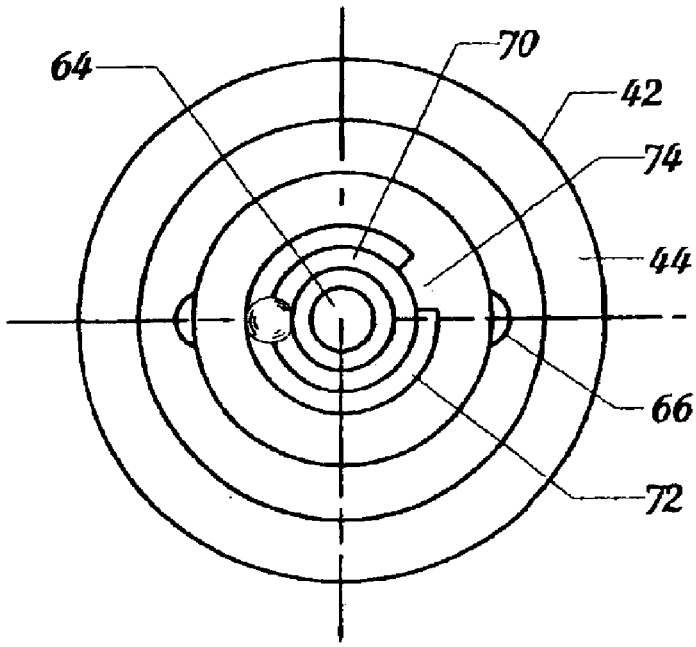
FIG. 6 is a bottom plan view of FIG. 5, showing a cam ball race and a cam ball stop.

A cam ball pilot member 68 having a central opening 73 is fitted in the circular recess 60 of the hammer cage 42. The cam ball pilot member 68 has a ball race 70 extending around its periphery and a complimentary ball race 72 is provided on the inner side of the top wall 48 at the edge of the circular recess 60. The complimentary ball race 72 extends circumferentially but does not form a complete ring-shaped configuration, thereby forming a stop member 74 protruding into the complimentary ball race 72. The ball races 70 and 72 are designed in combination to provide more than 180 degrees of concave surface in cross section, in order to accommodate a cam ball 76 so that the cam ball 76 can be rotatably supported in the combined ball race without need for other support, as shown in FIG. 5. The cam ball pilot member 68 is also designed to expose the bottom section of the cam ball 76 for contact with a cam plate 78 without interference, when the cam ball 76 is accommodated in the combined ball race.

The cam plate 78 includes a round plate 80 and a coaxial sleeve 82 axially extending therefrom. The sleeve 82 defines a central opening 83 axially extending through the round plate 80 and is provided on the inner surface thereof with splines 84. On the top surface of the round plate 80 is provided an axial projection 86 which includes a sloped cam surface 88. The sloped cam surface 88 begins at one of its edges 90 and smoothly extends from the top surface of the round plate 80, axially, upwardly and circumferentially, to its apex 92 and then extends axially, downwardly and circumferentially, terminating at the other edge 90, as more clearly shown in FIG. 4.

An anvil shank 94 having an axis 95, includes an anvil plate 96 with two radial projections 98 disposed on diametrically opposite sides thereof. The anvil shank 94 is provided with splines 100 on its upper section for slidable engagement with the splines 84 of the cam plate 78 when the cam plate 78 is received on the anvil shank 94. A compression coil spring 101 is disposed around the anvil shank 94 between the anvil plate 96 and the cam plate 78. An upper end 102 of the anvil shank 94 is rotatably received within the central opening 73 of the cam ball pilot member 68 (see FIG. 5) when the anvil shank 94 is installed within the hammer cage 42. The anvil plate 96 is accommodated within the first chamber 56 of the hammer cage 42 and is held in place by a spacer ring 104 and a retainer ring 106 which is received within an annual groove 108 in the inner surface of the first chamber 56 of the hammer cage 42.

As more clearly illustrated in FIG. 1, a bottom end 110 of the anvil shank 94 has for example, a rectangular cross-section which engages a correspondingly shaped central hole of the head plate 36 of the jar lid retainer 32 for transferring a twisting impact force. A mounting screw 112 and a washer 114 are used to secure the jar lid retainer 32 to the anvil shank 94.

A lower section of the anvil shank 94 rotatably extends through a central hole in the bottom end 16 of the cylindrical housing 12, and a bushing 116 is preferably provided around the lower section of the anvil shank 94. A roller bearing 118 is also preferably provided between the bottom end 16 of the cylindrical housing 12 and the head plate 36 of the jar lid retainer 32 in order to reduce friction between the jar lid retainer 32 and the cylindrical housing 12.

Figure 2:
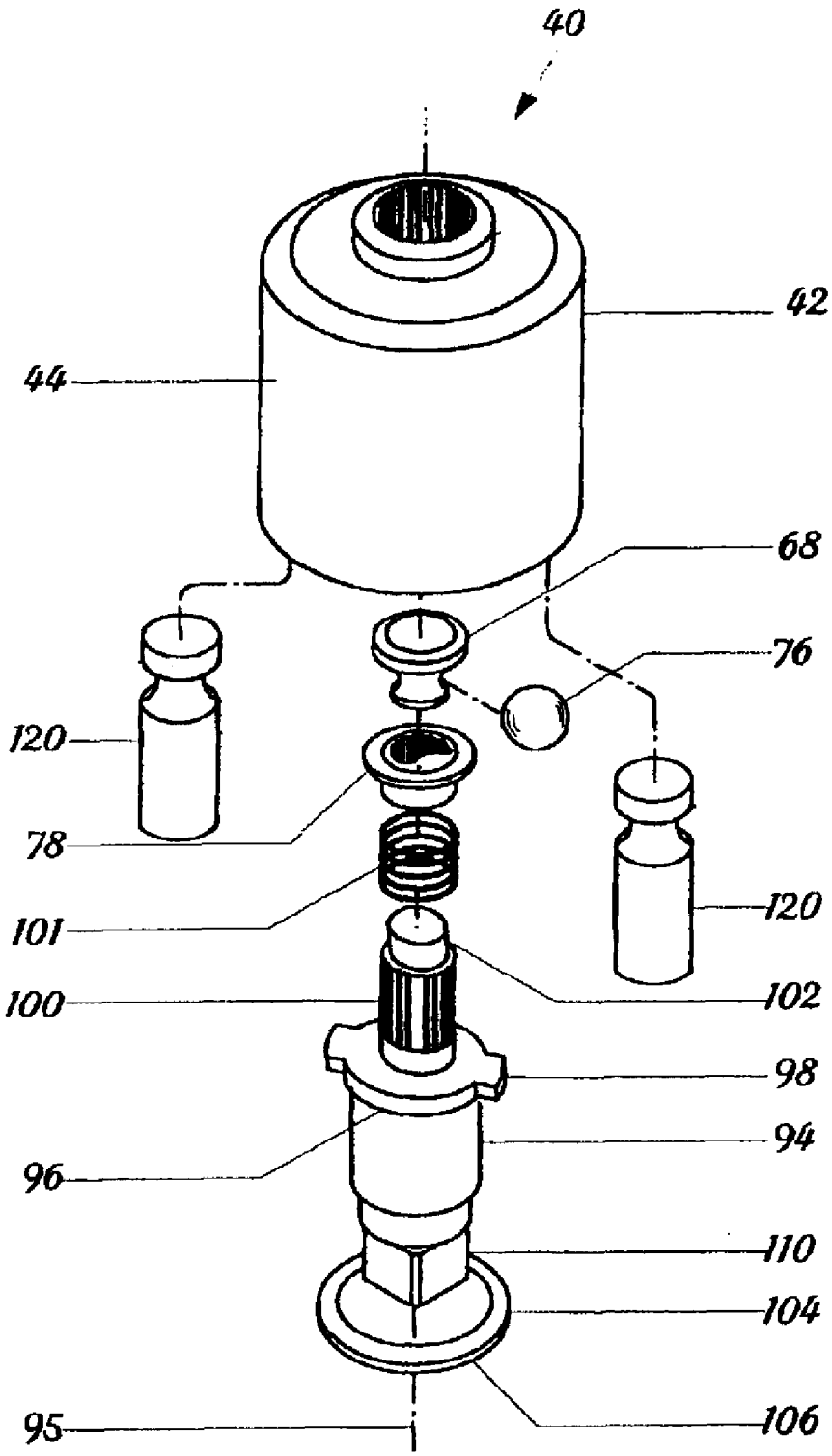
FIG. 2 is an exploded perspective view of a rotary hammer assembly used in the embodiment of FIG. 1.
Figure 3:
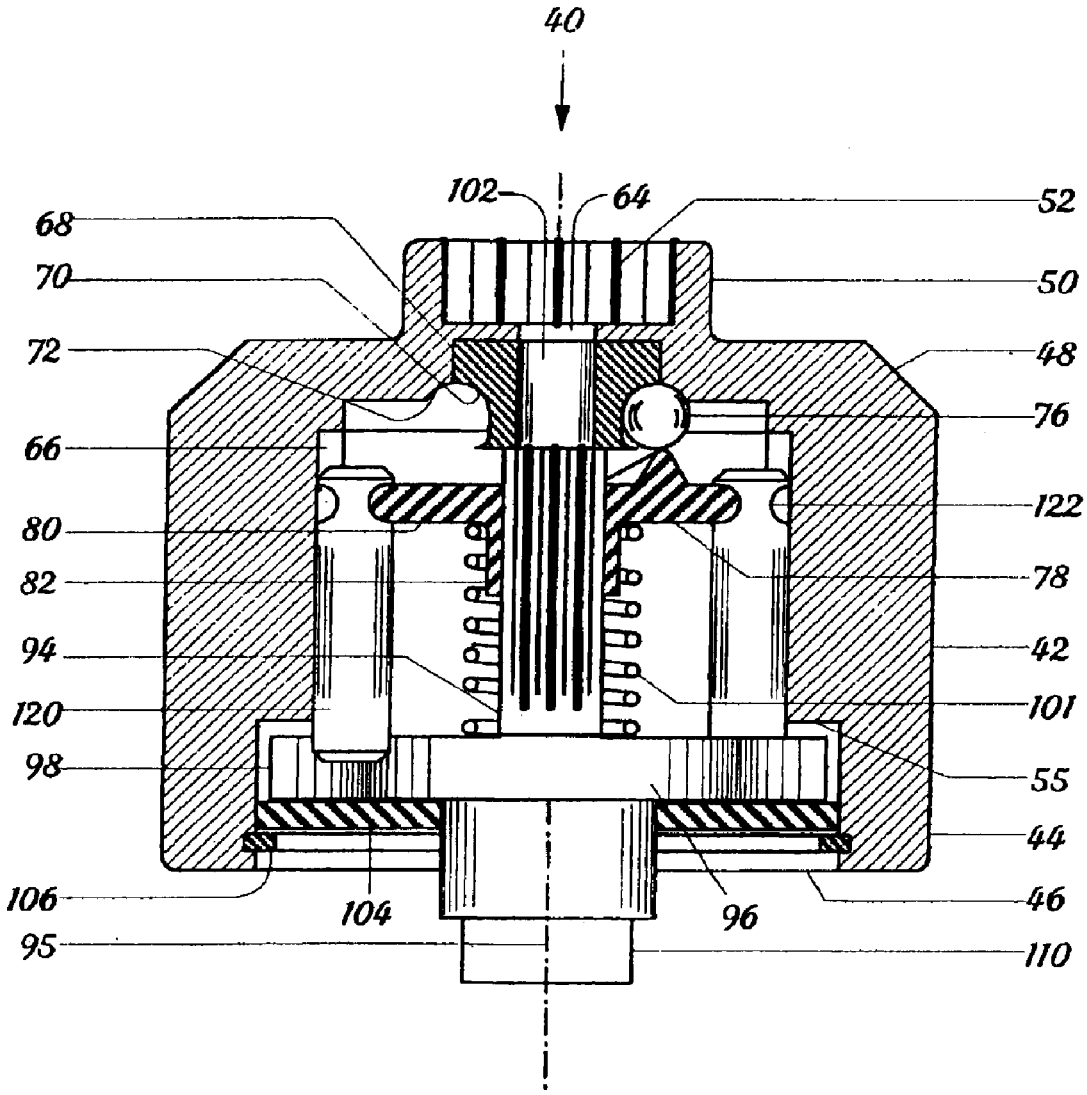
FIG. 3 is a cross-sectional view of the rotary hammer assembly used in the embodiment of FIG. 1, in which two hammer pins are in a lower and active position for a strike action.
Figure 4:
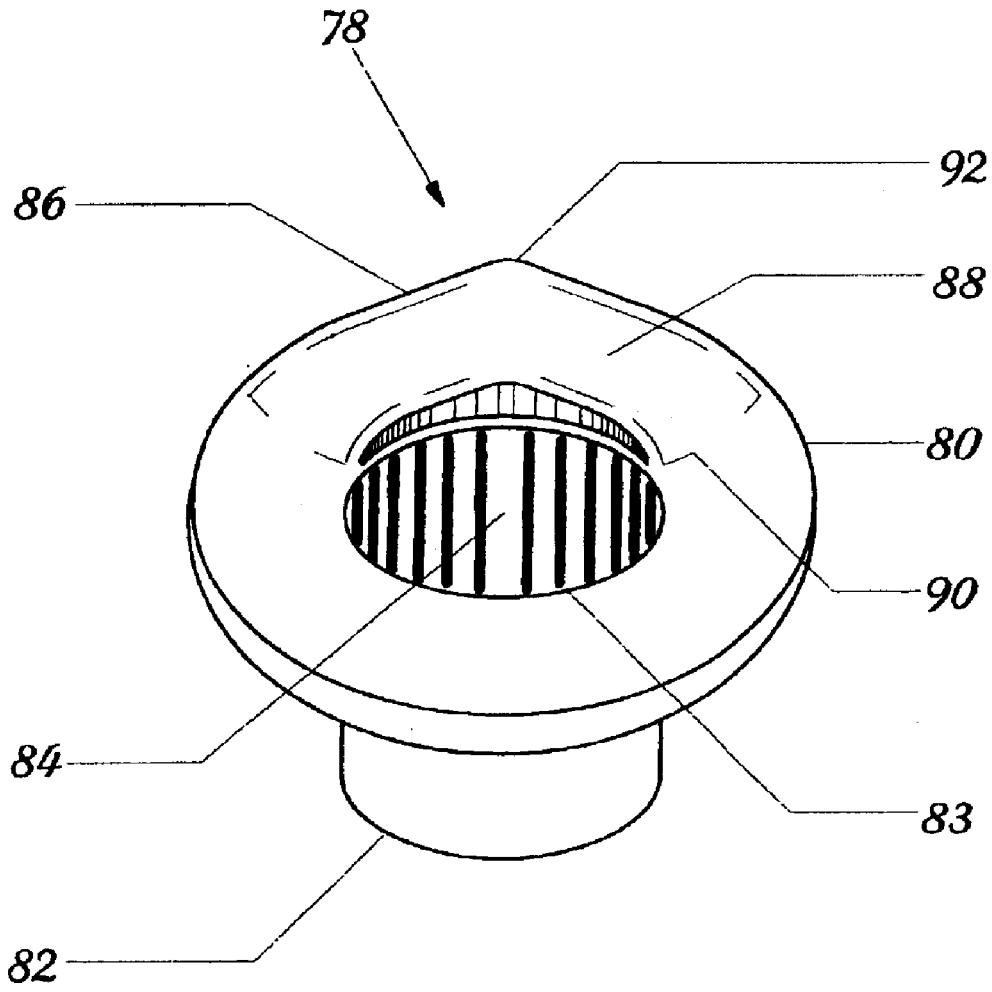
FIG. 4 is a perspective view of a cam used in the rotary hammer assembly of FIG. 3.

As illustrated in FIGS. 1–3, a pair of hammer pins 120 are slidably disposed in the respective axial grooves 66 of the hammer cage 42. Each hammer pin 120 has an annular radial recess 122 at its upper end for slidably receiving the upper periphery of the round plate 80 of the cam plate 78.

In operation, the jar lid opener 10 is gripped by one hand of a user and a jar to be opened is gripped by the other hand of the user. The jar lid opener 10 is placed on the jar such that the jar lid is pressed into the jar lid retainer 32 and is firmly gripped by the grip blades 38. When the activation switch 30 is actuated by the user, the motor assembly 20 drives the hammer cage 40 to rotate, which forces the two hammer pins 120 to move circularly about the axis 95 of the anvil shank 94. As illustrated in FIG. 1, the cam plate 78 is urged by the compression coil spring 101 to move upwardly, and thereby moves the two hammer pins 120 axially to their upper position. In this upper position, the hammer pins 120 are inactive because the hammer pins 120 cannot strike the two projections 98 of the anvil plate while circularly moving about the axis of the anvil shank 94.

The cam ball 76 is forced to move circularly about the anvil shank 94 when hammer cage 42 rotates and the ball stop 74 (see FIGS. 5 and 6) abuts the cam ball 76. The cam plate 78 is stationary at this moment because of its slidable engagement with the anvil shank 94. Thus, the circular movement of the cam ball 76 is guided by the top surface of the cam plate 78. When the cam ball 76 comes to the edge 90 of the radial projection 86 (see FIG. 4), the continuing circular movement of the cam ball 76 is then being guided by the sloped cam surface 88. The cam plate 78 is thereby pushed downwardly against the spring 101, resulting in downward axial movement of the hammer pins 120. Thus, the two hammer pins 120 are gradually moved into their lower position in which they become active to make a striking action against the radial projections 98 of the anvil plate 96, because the lower end of each hammer pin 120 extends downwardly into the level below the top surface of the anvil plate 96 (see FIG. 3). The circular movement of the hammer pins 120 is synchronized with the circular movement of the cam ball 76 in a manner such that when the cam ball 76 reaches the apex 92 of the sloped cam surface 88 (see FIG. 4) the hammer pins 120 are moved to strike the radial projections 98 of the anvil shank plate 96 (see FIG. 3). The spline engagement between the cam plate 78 and the anvil shank 94 has a tolerance which permits a slight relative rotation between the cam plate 78 and the anvil shank 94. The cam plate 78 and the two hammer pins 120 are urged by the spring 101 upwardly to resume their upper position as shown in FIG. 1, gradually after the strike action of the hammer pins 120 on the radial projections 98 of the anvil plate 96, because the continuing circular movement of the cam ball 76 causes the cam ball 76 to move along the sloped cam surface 88 from the apex 92, gradually to the flat top surface of the round cam plate 80.

Thus, the rotary hammer assembly 40 converts the torque output of the motor assembly 20 into the strike action of the hammer pins 120 on the anvil shank 94 with each revolution of the hammer cage 42, and thereby generates a twisting impact force applied through the jar lid retainer 32 to the lid screwed on the jar. This striking operation continues until the user observes rotation of the jar lid retainer 32, which indicates the lid having been loosened, and turns off activation switch 30.

Figure 7:
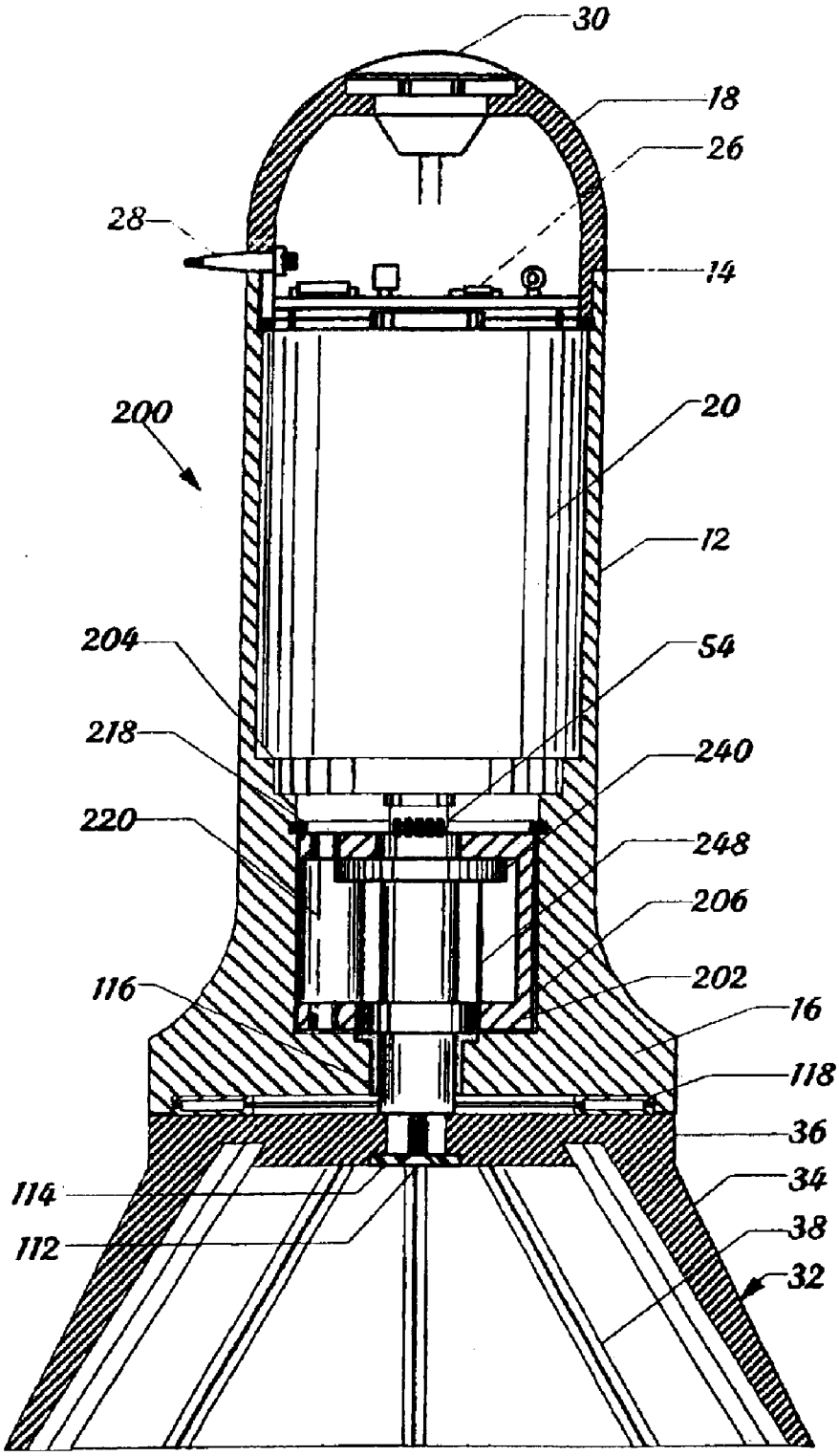
FIG. 7 is a cross-sectional view of another preferred embodiment of the present invention.
Figure 8:
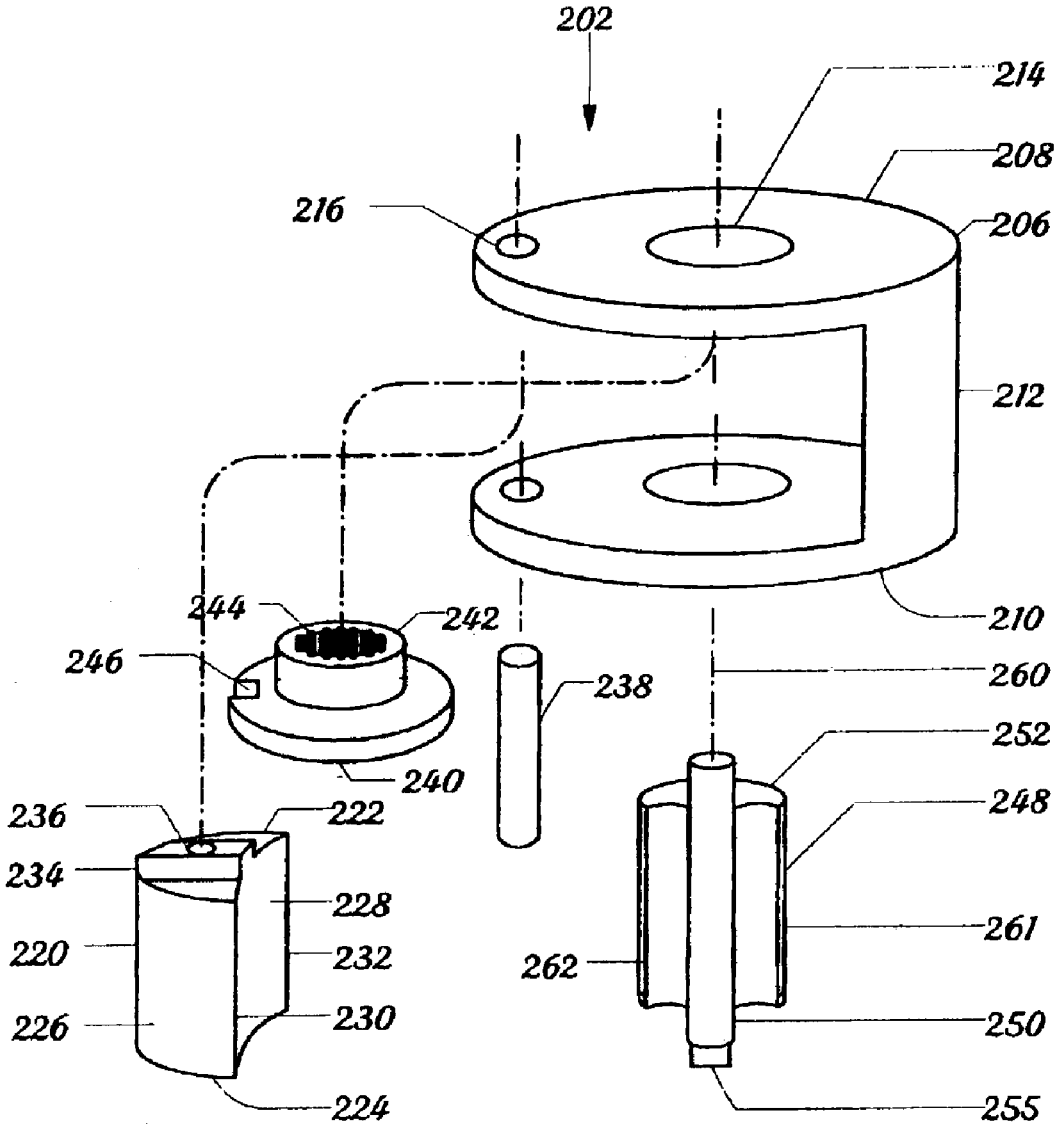
FIG. 8 is an exploded perspective view of a rotary hammer assembly used in the embodiment of FIG. 7.

FIG. 7 illustrates a jar lid retainer according to another embodiment of the present invention, generally indicated by numeral 200 which is similar to the embodiment of the powered jar lid opener 10 illustrated in FIG. 1. With the exception of a rotary hammer assembly 202, the embodiment of the powered jar lid opener 200 has a configuration similar to that of the embodiment 10 illustrated in FIG. 1, and similar components are indicated by similar numerals and will not therefore be redundantly described herein. The motor assembly 20 of the embodiment 200 is installed within the cylindrical housing 12 and is secured directly between an inner shoulder 204 and the domed cover 18. Nevertheless, the motor bracket 22 and retainer 24 in FIG. 1 could also be used in this embodiment. As more clearly illustrated in FIGS. **7–9*b*, the rotary hammer assembly 202 includes a hammer cage 206 which is formed with upper and lower disks 208 and 210 positioned parallel with each other and spaced apart by a connection portion 212. The connection portion 212 is a circumferential section of a cylindrical wall extending between the disks 208, 210. A central opening 214 and a hole 216 extend through each of the the respective disks 208 and 210 and the holes 216 are disposed diametrically opposite to the connection portion 212. The holes 216 are aligned with each other. The hammer cage 206 is rotatably received within the cylindrical housing 12, resting on the bottom end 16 thereof and is restrained thereto by a retaining ring 218 deformably received in an annular groove (not indicated) in the inner surface of the cylindrical housing 12**.

A hammer dog 220 includes a body having a top end 222 and a bottom end 224. A convex surface 226 and a concave surface 228 extend between the top and bottom ends 222 and 224 and join together to form rearward and forward axial edges 230 and 232. A projection 234 extends upwardly from the top end 222 of the hammer dog 220 at the middle thereof and an axial passage 236 extends through the hammer dog 220. A hammer pin 238 is rotatably received in the axial passage 236 of the hammer dog 220 and the two ends of the hammer pin 238 are engaged in the respective holes 216 in the hammer cage 206, such that the hammer dog 220 is mounted in the hammer cage 206 and is pivotable about the hammer pin 238.

A driving plate 240 with a sleeve member 242 extending upwardly therefrom defines a central hole with inner splines 244, such that the driving plate 240 is coupled with the motor assembly 20 when the sleeve member 242 is inserted from the under side of the upper disk 208 into the central opening 214, and the inner splines 244 thereof engage the splines 54 on the output shaft (not indicated) of the motor assembly 20 (see FIG. 7). The driving plate 240 defines a radial recess 246 for loosely receiving the projection 234 of the hammer dog 220. The radial recess 246 has an appropriate depth to receive the projection 234 to an extent such that a push force from the driving plate 240 is applied to the proximity of the axis of the hammer pin 238, and the radial recess 246 has an appropriate width to permit the hammer dog 220 to slightly pivot about the hammer pin 238.

An anvil shank 248 includes a shank member 250 and a anvil body 252 affixed to the shank member 250. The anvil body 252 forms a circumferential surface 254 having a varying radius with respect to the axis 260 of the shank member 250, and a radial recess (not indicated) defined between two ends 256, 258 thereof, as is more clearly shown in FIGS. 9*a* and 9*b*. The two ends 256, 258 are circumferentially spaced apart. The circumferential surface 254 is formed as a cam surface defining a varying radial distance from the axis 260. The varying radial distance between the circumferential surface 254 and the axis 260, is illustrated by the arrow Rx, and is largest when arrow Rx is pointing to the surface 254 near the two ends 256 and 258. The radial distance gradually decreases to become smallest when Rx is rotating to point to the surface 254 at the middle point thereof, as shown in FIG. 9*b*. The top end of the shank member 250 extending upwardly from the anvil body 252 is rotatable in a small central hole (not shown) in the bottom end of the driving plate 240, and a lower section of the shank member 250 extending downwards from the anvil body 252 is rotatably received within the bushing 116 (see FIG. 7) which in turn is received in the central hole of the bottom end 16 of the cylindrical housing 12. A bottom end 255 of the shank member 250, having for example a rectangular cross-section, is engaged with a corresponding rectangular opening in the jar lid retainer 32 for transmitting a twisting impact force from the anvil shank 248 to the jar lid retainer 32, similar to the embodiment 10 in FIG. 1. The anvil body 252 is disposed between the disks 208 and 210 (alternatively, the anvil body 252 can extend into the opening 214 of the lower disk 210) such that the hammer cage 206 can freely rotate about the axis of the anvil shank 248 within the cylindrical housing 12 when the driving plate 240 driven by the motor assembly 20 applies a force on the projection 234 of the hammer dog 220. The hammer dog 220 moves circularly about the axis of the anvil shank 248 when the hammer cage 206 is driven to rotate, and pivotable about the hammer pin 238 which is parallel to the axis 260 of the avil shank 248.

Figure 9A:
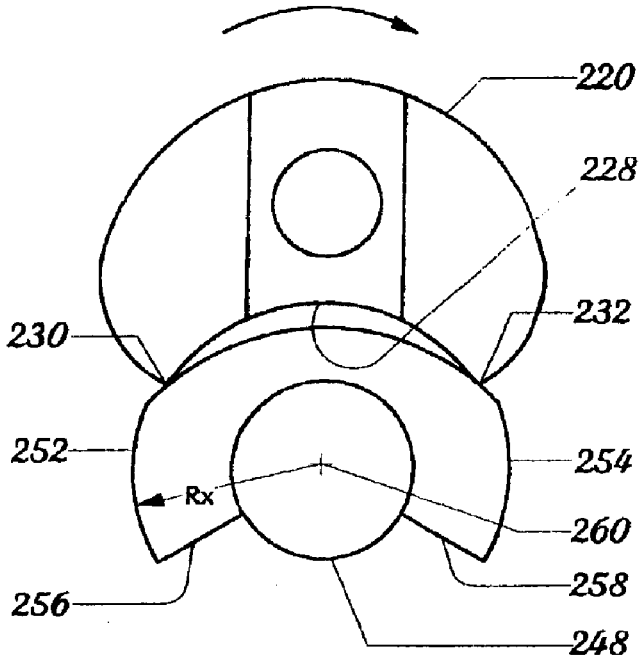
FIG. 9*a* is a schematic top plan view of the hammer dog used in the rotary hammer assembly of FIG. 8, moving around the anvil shank and in an inactive position regarding a strike action on the anvil shank.
Figure 9B:
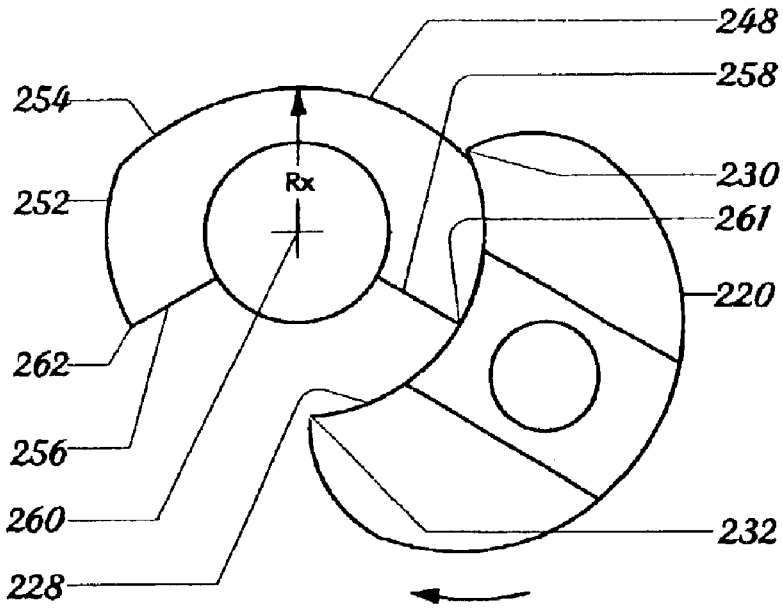
FIG. 9*b* is a schematic top plan view of the hammer dog of FIG. 9*a* moving around the anvil shank and in an active position regarding the strike action on the anvil shank.

More particularly referring to FIGS. 9*a* and 9*b*, the concave surface 228 of the hammer dog 220 has a radius of curvature similar to that of the circumferential surface 254 near the ends 256, 258. Thus, in operation the rearward and forward axial edges 230, 232 of the hammer dog 220 are in contact with the circumferential surface 254 of the anvil shank 248 and are guided by same when the hammer dog 220 moves circularly about the axis 260, as shown in FIG. 9*a*. This position is referred to as the inactive position in which the hammer dog 220 cannot make a strike action on the anvil shank 248 while moving circularly about the axis 260. When the hammer dog 220 moves circularly and clockwisely about the axis 260, particularly from the position shown in 9*a*, the forward edge 232 is guided by the circumferential surface 254 to move gradually away from the axis 260 while the rearward edge 230 is guided to move gradually closer to the axis 260. When the forward edge 232 passes the end 258, and the rearward edge 230 is guided by the right side of the circumferential surface 254, this is referred to as an active position, as shown in FIG. 9*b*. In this active position, the rearward edge 230 is forced to move gradually away from the axis 260 such that the forward edge 232 is pivoted slightly inwardly towards the axis 260. Thus, the forward edge 232 strikes the end 256 of the anvil body 252 when the hammer dog 220 continues its circular movement and the forward edge 232 reaches the end 256.

Nevertheless, the slight pivoting of the hammer dog 220 is limited such that the forward edge 232 strikes an edge area 262 which is somewhat rounded. At this point, the rearward edge 230 reaches a similarly rounded edge 261 of the end 258 of the anvil body 252 such that the forward edge 232 and the rearward edge 230 are guided by the respective rounded edges 262 and 261 to slightly pivot counter-clockwisely when the hammer dog 220 continues the circular movement. Thus, the forward edge 232 of the hammer dog 220 moves over the rounded edge area 262 of the end 256 and returns to move along the circumferential surface 254 of the anvil body 252. The hammer dog 220 continues to move circularly about the axis 260 and is guided by the circumferential surface 254, thereby causing the rearward edge 230 of the hammer dog 220 to return to move along the circumferential surface 254 and gradually resume the inactive position illustrated in FIG. 9*a*, thereby completing a full cycle.

The strike action of the hammer dog 220 on the anvil shank 248 continues once per revolution of the hammer cage 206 until the twisting impact force applied by the jar lid retainer 32 on the lid breaks the seal or initial resistance securing the lid on the jar.

It should be noted that both embodiments 10 and 200, of the jar lid openers as illustrated in FIGS. 1 and 7 respectively, can be operated in either rotational direction as required.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

I claim:

1. A jar lid opener for loosening a threaded jar lid on a jar comprising:

a housing;

a jar lid retainer rotatably attached to the housing for contacting the lid and for applying a twisting impact force to the lid in order to loosen the lid on the jar, the jar lid retainer including a truncated conical grip head for accommodating lids of various sizes, and a plurality of hardened blades axially and radially extending on an inner surface of the truncated conical grip head;

a motor installed in the housing for generating a torque;

a rotary hammer assembly defining a rotating axis thereof installed in the housing and co-axially coupled with the motor and the jar lid retainer for converting the torque output from the motor into the twisting impact force applied by the jar lid retainer to the lid; and a plurality of rotary axial bearing elements disposed between the bottom end of the housing and a head plate of the jar lid retainer.

2. A jar lid opener as claimed in claim 1 wherein the rotary hammer assembly comprises:

a first rotary element adapted to be driven by the motor to rotate;

a second rotary element adapted to rotate together with the jar lid container; and a hammer device driven by the first rotary element to strike the second rotary element in order to begin rotation.

3. A jar lid opener as claimed in claim 2 wherein the hammer device strikes the second rotary element repeatedly, one time per revolution of the first rotary element.

4. A jar lid opener as claimed in claim 1 wherein the rotary hammer assembly comprises:

an anvil shank engaging the jar lid retainer, rotatable together with the jar lid retainer;

a hammer member circularly moveable about an axis of the anvil shank, and being adapted to strike the anvil shank to rotate; and means coupled with the motor for driving the hammer member to move circularly.

5. A jar lid opener as claimed in claim 4 wherein the rotary hammer assembly comprises a cam surface, the hammer member in the circular movement being guided by the cam surface to change between active and inactive positions regarding the strike action on the anvil shank.

6. A jar lid opener as claimed in claim 4 wherein the means for driving the hammer member comprises a hammer cage rotatable about the axis of the anvil shank for receiving the hammer member therein but permitting the hammer member to move axially between an upper position in which the hammer member can not be in contact with the anvil shank, and a lower position in which the hammer member can be in contact with the anvil shank when in a predetermined angular position with respect to the anvil shank.

7. A jar lid opener as claimed in claim 6 wherein the means for driving the hammer member further comprises a cam and spring assembly within the hammer cage, during each revolution of the hammer cage the cam, and spring assembly moving the hammer member gradually downwards from the upper position to the lower position and urging the hammer member to return to the first position immediately after the hammer member strikes the anvil shank.

8. A jar lid opener as claimed in claim 7 wherein the hammer member comprises a pair of hammer pins.

9. A jar lid opener as claimed in claim 8 wherein the anvil shank comprises a pair of radial projections for receiving the strike by the respective hammer pins.

10. A jar lid opener as claimed in claim 4 wherein the means for driving the hammer member comprises a hammer cage rotatable about the axis of the anvil shank and a driving plate engaging a shaft of the motor and rotatable about the axis of the anvil shank, the hammer member being mounted to the hammer cage and being pivotal about an axis parallel to the axis of the anvil shank, the hammer member operatively engaging the driving plate such that the hammer member moves circularly about the axis of the anvil shank and strikes the anvil shank.

11. A jar lid opener as claimed in claim 10 wherein the anvil shank in a cross-section comprises a circumferential surface with a radial recess defined between two ends thereof circumferentially spaced apart, the circumferential surface being formed as to define a varying radial distance between the circumferential surface and the axis of the anvil shank, the hammer member thereby being guided by the circumferential surface to slightly pivot to strike one of the ends of the recess when circularly moving about the axis of the anvil shank.

12. A jar lid opener as claimed in claim 11 wherein thin hammer member comprises axially extending forward and rearward edges, and a concave surface extending between the two edges, the rearward edge being guided by the circumferential surface to move outwardly and radially and thereby causing a forward edge thereof to move radially and inwardly to strike said one of the ends of the recess when the hammer member moves circularly about the axis of the anvil shank and the forward edge thereof moves over the recess to approach said one of the ends of the recess.

13. A jar lid opener as claimed in claim 12 wherein each of the respective ends of the recess comprises a rounded edge such that the forward edge of the hammer member is guided to move over the rounded edge to the circumferential surface immediately after striking the rounded edge of said one of the ends.

14. A jar lid opener for loosening a threaded jar lid on a jar comprising:

a substantially cylindrical housing having a top end and a bottom end thereof;

a jar lid retainer rotatably attached to the housing at the bottom end thereof for contacting the lid and for applying a twisting impact force to the lid in order to loosen the lid on the jar;

a motor installed in the housing at the top end thereof for generating a torque;

a rotary hammer assembly installed in the housing at the bottom end thereof and coupled with the motor and the jar lid retainer for converting the torque output from the motor into the twisting impact force applied by the jar lid retainer to the lid, the rotary assembly including:

an anvil shank engaging the jar lid retainer, and rotatable together with the jar lid retainer;

a hammer cage rotatable about an axis of the anvil shank, and coupled with the motor;

at least one hammer pin received in the hammer cage, and axially moveable between an upper position in which the hammer pin cannot be in contact with the anvil shank when the hamper cage rotates, and a lower position in which the hammer pin is in an active position to strike the anvil shank;

a cam plate attached to the anvil shank in order to force the hammer pin to move axially between the upper and lower positions when the hammer cage rotates; and a plurality of rotary axial bearing elements disposed between the bottom end of the housing and a head plate of the jar lid retainer.

15. A jar lid opener for loosening a threaded jar lid on a jar comprising:

a substantially cylindrical housing having a top end and a bottom end thereof;

a jar lid retainer rotatably attached to the housing at the bottom end thereof for contacting the lid and for applying a twisting impact force to the lid in order to loosen the lid on the jar;

a motor installed in the housing at the top end thereof for generating a torque;

a rotary hammer assembly installed in the housing at the bottom end thereof and coupled with the motor and the jar lid retainer for converting the torque output from the motor into the twisting impact force applied by the jar lid retainer to the lid, the rotary assembly including:

an anvil shank including a cam surface, the anvil shank engaging the jar lid retainer, and being rotatable together with the jar lid retainer;

a hammer cage rotatable about an axis of the anvil shank;

a hammer dog mounted on the hammer cage, and pivotal relative to the hammer cage about an axis parallel with the axis of the anvil shank, the hammer dog being guided by the cam surface of the anvil shank to strike the anvil shank one time upon each revolution of the hammer cage;

a driving plate coupled with the motor and linked with the hammer cage for driving the hammer cage to rotate; and a plurality of rotary axial bearing elements disposed between the bottom end of the housing and a head plate of the jar lid retainer.

* * * * *